US009085018B2

(12) United States Patent
Lafon et al.

(10) Patent No.: US 9,085,018 B2
(45) Date of Patent: Jul. 21, 2015

(54) PIPE CLEARING SYSTEMS

(75) Inventors: Rémi Lafon, Evenos (FR); Alexis Pierrot, Marseilles (FR); Jean-lue Combal, Le Beausset (FR)

(73) Assignee: The Coca-Cola Company, Atlanta, GA (US)

( * ) Notice: Subject to any disclaimer, the term of this patent is extended or adjusted under 35 U.S.C. 154(b) by 572 days.

(21) Appl. No.: 12/859,354

(22) Filed: Aug. 19, 2010

(65) Prior Publication Data

US 2010/0313914 A1 Dec. 16, 2010

Related U.S. Application Data

(62) Division of application No. 11/683,566, filed on Mar. 8, 2007, now Pat. No. 7,950,403.

(51) Int. Cl.
*B08B 9/032* (2006.01)

(52) U.S. Cl.
CPC ..... *B08B 9/0325* (2013.01); *B08B 9/032* (2013.01); *B08B 9/0321* (2013.01)

(58) Field of Classification Search
None
See application file for complete search history.

(56) References Cited

U.S. PATENT DOCUMENTS

| | | | | |
|---|---|---|---|---|
| 3,169,545 | A | 2/1965 | Kolling | |
| 3,657,011 | A | 4/1972 | Orr | |
| 4,090,572 | A * | 5/1978 | Welch | 175/16 |
| 5,192,340 | A | 3/1993 | Grant et al. | |
| 5,427,126 | A | 6/1995 | Carney et al. | |
| 5,704,990 | A | 1/1998 | Krambrock et al. | |
| 5,724,701 | A | 3/1998 | Jones | |
| 5,862,439 | A | 1/1999 | Pozzanghera | |
| 5,915,395 | A | 6/1999 | Smith | |
| 6,454,871 | B1 | 9/2002 | Labib et al. | |
| 2002/0112743 | A1 | 8/2002 | Tabani et al. | |
| 2002/0189647 | A1 | 12/2002 | Labib et al. | |
| 2003/0134037 | A1 | 7/2003 | Wang et al. | |
| 2004/0007255 | A1 | 1/2004 | Labib et al. | |
| 2004/0050144 | A1 | 3/2004 | Bratton et al. | |
| 2005/0126599 | A1 | 6/2005 | Labib et al. | |
| 2005/0150831 | A1 | 7/2005 | Tabani et al. | |
| 2005/0183744 | A1 | 8/2005 | Staub et al. | |
| 2006/0099905 | A1 | 5/2006 | Viola | |
| 2008/0264454 | A1 | 10/2008 | Tabani et al. | |

FOREIGN PATENT DOCUMENTS

| | | | |
|---|---|---|---|
| DE | 19922084 | A1 | 11/2000 |
| DE | 2629301 | A1 | 1/2008 |
| EP | 1220722 | B1 | 9/2000 |
| EP | 1647780 | A1 | 4/2006 |
| GB | 2353837 | A1 | 3/2001 |
| JP | 63-52832 | | 3/1988 |
| JP | 2003508220 | | 3/2003 |
| JP | 2003-033741 | | 4/2003 |
| WO | 0117700 | A1 | 9/1999 |
| WO | 0191931 | A1 | 12/2001 |
| WO | 2005105331 | A1 | 11/2005 |

* cited by examiner

*Primary Examiner* — Michael Kornakov
*Assistant Examiner* — Ryan Coleman
(74) *Attorney, Agent, or Firm* — Sutherland Asbill & Brennan LLP

(57) ABSTRACT

A method of clearing a pipe of contents with an air system. The method may include providing air by the air system at high pressure and low velocity until the contents begin to move within the pipe, providing air by the air system air at low pressure and high velocity until a majority of the contents are removed from the pipe, and continuing to provide air at low pressure and high velocity until substantially all remaining contents are removed from the pipe.

15 Claims, 1 Drawing Sheet

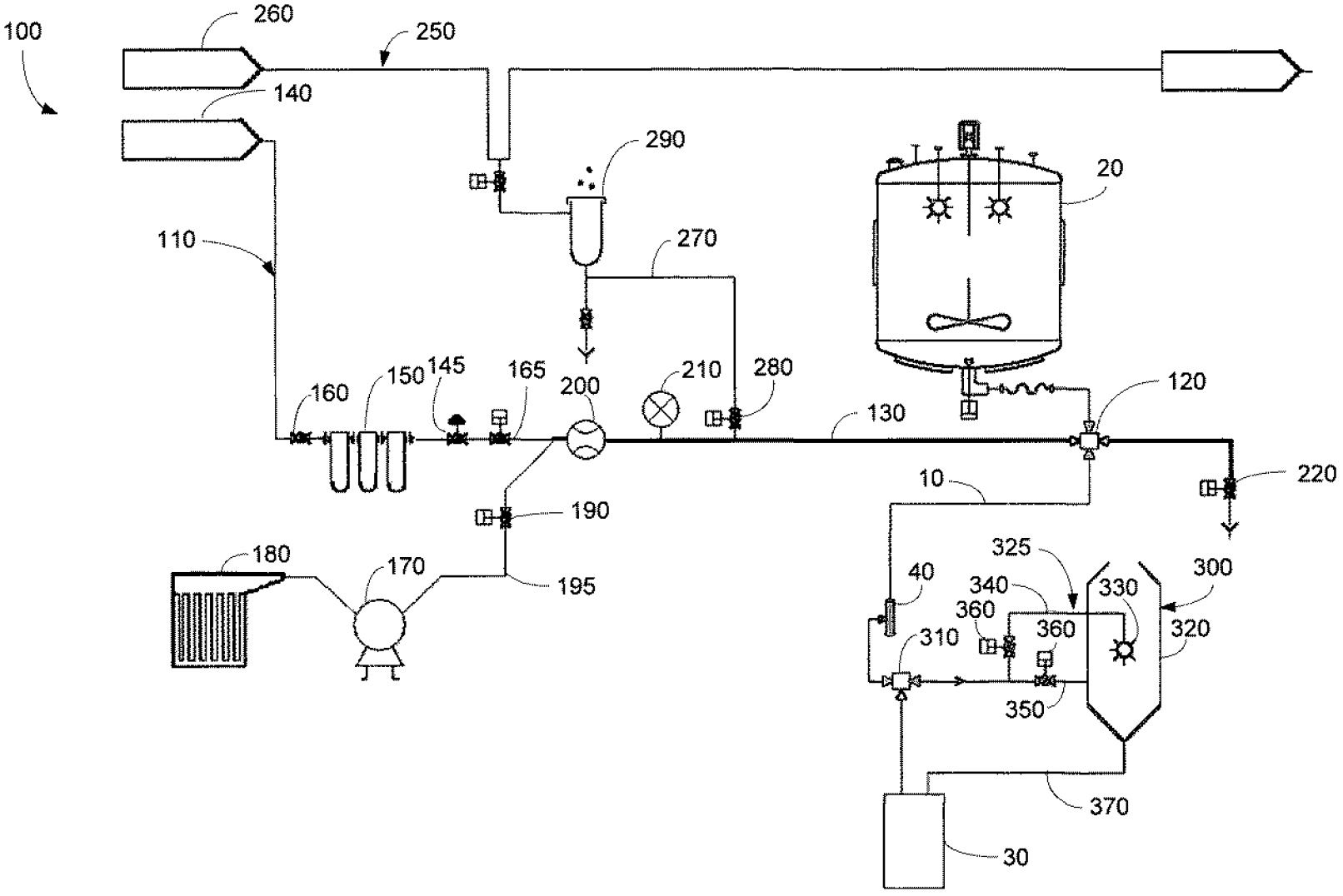
100
110
140
260
250
150
160
145
165
170
180
190
195
200
210
280
290
270
130
20
120
220
10
40
310
325
330
300
320
340
360
360
350
370
30

PIPE CLEARING SYSTEMS

RELATED APPLICATIONS

The present application is a divisional of pending U.S. patent application Ser. No. 11/683,566, entitled "Pipe Clearing System", filed on Mar. 8, 2007. U.S. patent application Ser. No. 11/683,566 is incorporated herein by reference in full.

TECHNICAL FIELD

The present application relates generally to pipe clearing systems and more particularly relates to methods and apparatuses to clear a length of pipe via air flow.

BACKGROUND OF THE INVENTION

Removing the contents of a typical length of pipe often may be difficult due to the nature of the contents or the geometry of the pipe itself. For example, a viscous liquid may be difficult to place in motion and may leave a significant amount of residue on the walls of the pipe.

Known air flow systems generally involve large, powerful blowers so as to provide the air pressure and the velocity needed to remove substantially all of the contents from the pipe, including most of the residue. It is possible, however, for the air used to clear the pipe to contaminate the contents therein. Separate sanitation systems are known, but these systems also add to the complexity of the system as a whole.

There is a desire, therefore, for simplified pipe clearing systems. The systems preferably can clear a length of pipe in a fast and efficient manner, including the residue on the walls of the pipe while maintaining the sanitation of the system as a whole.

SUMMARY OF THE INVENTION

The present application thus provides a method of clearing a pipe of contents with an air system. The method may include providing air by the air system at high pressure and low velocity until the contents begin to move within the pipe, providing air by the air system air at low pressure and high velocity until a majority of the contents are removed from the pipe, and continuing to provide air at low pressure and high velocity until substantially all remaining contents are removed from the pipe.

The high pressure may include about 0.5 to about 2.0 bars. The low pressure may include about 0.2 bars. The high velocity may include up to about ten (10) meters per second. The step of continuing to provide air at low pressure and high velocity until substantially all remaining contents are removed from the pipe may include flowing the remaining contents to a fluid-gas separator. The method further may include rinsing the air system, drying the air system, and chlorinating the air system.

The present application further describes a clearing system for a pipe. The cleaning system may include an air system in communication with the pipe, a chlorinated water system in communication with the air system, and a collection system in communication with the pipe. The air system may include a compressed air source and a blower. The collection system may include a fluid-gas separator.

The air system may include a separation valve in communication with the pipe and an escape valve downstream of the separation valve. The air system may include a pressure regulator, an air filter in communication with the compressed air source, and an air filter in communication with the blower. The air system may include a flowmeter and a pressure meter. The collection system may include a retention tank and a clean in place system. The clean in place system may include a spray ball about the retention tank. The chlorinated water system may include a source of treated water.

The application further describes a system for a clearing the contents of a pipe. The system may include an air line in communications with the pipe, a compressed air source in communication with the air line, a blower in communication with the air line, a sanitation system in communication with the air line, and a collection system in communication with the pipe. The compressed air source may include a high pressure operation to begin movement of the contents in the pipe and a low pressure operation once movement has begun.

These and other features of the present application will become apparent to one of ordinary skill in the art upon review of the following detailed disclosure when taken in conjunction with the drawing and the appended claims.

BRIEF DESCRIPTION OF THE DRAWING

FIG. 1 is a schematic view of a pipe clearing system as is described herein.

DETAILED DESCRIPTION

The systems described herein are intended to be used to clear a length of a pipe 10. The pipe 10 may be of any shape or dimension and made from any type of material. In this example, the pipe 10 is used to connect a mixing tank 20 with a filler 30 of a beverage bottling system. The mixing tank 20 may be used to mix various ingredients so as to form a beverage, a beverage base, a juice or a juice blend, and more basically any type of liquid. For example, the mixing tank 20 may be used to mix syrup and water to form a typical carbonated beverage. The pipe 10 may lead to the filler 30. The filler 30 dispenses the beverage into bottles, cans, drums, jars, and other conventional types of containers. A filter 40 and a number of valves may be positioned on the pipe 10. The use of the mixing tank 20 and the filler 30 is by way of example only. The pipe 10 also could go from a mixing tank to another mixing tank. The pipe 10 described herein may be used to transport any type of contents to and from any location. Likewise, the systems described herein may clear any such contents.

Referring now to the drawing in which like numerals refer to like elements throughout the view, FIG. 1 shows a pipe clearing and sanitation system 100 as is described herein. The pipe clearing and sanitation system 100 is used to clear the length of pipe 10 at the end of a filling or a post mixing operation as is described above.

The pipe clearing and sanitation system 100 includes an air system 110. The air system 110 connects to the pipe 10 via a three way valve 120 and an air line 130. The three way valve 120 may be an automatic separation valve that prevents any contamination of the air system 110 from the contents of the pipe 10. The air line 130 may be made out of stainless steel 316 and similar types of materials.

The air system 110 may include a compressed air source 140. The compressed air source 140 may provide compressed air at about six (6) bars or so via a pressure regulator 145. Other pressures may be used herein. The compressed air source 140 may include a standard air compressor, an air accumulation system, or similar types of devices. The compressed air source 140 may be connected to the air line 130 by one or more sterile air filters 150. The sterile air filters 150 may be of conventional design and may include a class H13 filtering system with an efficiency for 0.01 micron particles of about 99.9%. Similar types of filters may be used herein. One or more compressed air valves 160, 165 may be positioned on either side of the air filters 150.

The air system 110 also may include a blower 170 in communication with the air line 130. The blower 170 may be a conventional fan or other type of air movement device. The blower 170 may provide air at a velocity of up to about 45 meters per second. Other velocities may be used herein. One or more sterile air filters 180 may be positioned upstream of the blower 170. The sterile air filters 180 may be of conventional design and may include a class H13 filtering system with an efficiency for 0.01 micron particles of about 99.9%. Similar types of filters may be used herein. The blower 170 may be in communication with the air line 130 via a blower valve 190 and a connector line 195.

The air system 110 also includes a flow meter 200 and a pressure transmeter 210. The flow meter 200 may be of conventional design and may be capable of air flow measures in a pressurized environment with variable pressures from about zero (0) to about three (3) bars or so. The flow meter 200 measures the velocity of the airflow through the air line 130. Likewise, the pressure transmeter 210 may be of conventional design. The pressure transmeter 210 measures the pressure of the airflow in the air line 130. The air system 110 also may include an escape valve 220 positioned downstream of the three way valve 120. The escape valve 220 permits removal of the sanitation fluid as will be described in more detail below.

The pipe clearing and sanitation system 100 also includes a water system 250. The water system 250 includes a source of treated water 260. The water may be treated via decarbonation using calcium hydroxide then chlorination at about three (3) parts per million for storage and with carbon filtration prior to use. Similar treatment methods also may be used herein. The water system 250 includes a water line 270 in communication with the air line 130 of the air system 110. The water line 270 may be made out of stainless steel 316 or similar types of materials. The water line 270 connects to the air line 130 via a water valve 280. The water system 250 also includes a chlorination system 290 using chlorine tablets to obtain a chlorine solution at about 150 parts per million. Other types of solutions may be used herein. The chlorination system 290 may chlorinate and sanitize the water so as to sanitize the air line 130 as will be described in more detail below The pipe clearing and sanitation system 100 also includes a collection system 300. The collection system 300 connects with the pipe 10 via a collection valve 310. The collection valve 310 may be a standard three way valve or similar type of valve. The collection system 300 also includes a retention tank 320. The retention tank 320 may be of any desired size or design. The retention tank 320 may be sanitized via a clean in place system 325. The clean in place system uses a spray ball 330 positioned within the tank 320. The spray ball 330 is attached to the pipe 10 via a clean in place line 340 and a standard butterfly valve 360. The retention tank 320 operates as a fluid-gas separator so as to remove the air flow from the contents of the pipe 10. The liquid goes down within the tank 320 by the force of gravity while the air evacuates.

The retention tank 320 may be connected to the collection valve 310 via a collection line 350 and a standard motorized butterfly valve 360. The collection line 350 may be made out of stainless steel 316 or similar types of materials. The retention tank 320 also may be in communication with the filler 40 via a filler line 370.

In use, the pipe clearing and sanitation system 100 may be used to clear the pipe 10 in a number of different ways. The following methods are described for purposes of example only. For example, the pipe 10 may be cleared in a five (5) step process involving push, scrape, rinse, dry, and chlorination and dry. Other methods may be used herein.

In this example, the pipe 10 is filled with contents such as a fluid and more typically a viscous fluid. In the push step, the three way valve 120 of the air system 110 opens as well as the compressed air valves 160 on the air line 130. The compressed air source 140 thus provides a controlled laminar airflow at about six (6) bars, which is then regulated to about one half (0.5) to about two (2) bars via the pressure regulator 145. The air flow starts to push the contents through the pipe 10. The compressed air source 140 may provide high pressure with low velocity until the contents within the pipe 10 begin in motion. The pressure may be about 0.5 to about 2.0 bars at a velocity of about zero (0) to about ten (10) meters per second. Other pressures and velocities may be used herein.

The pressure will be reduced as the contents begin to flow. The pressure may go down to about 0.4 to about 0.6 bars or so. Other pressures may be used herein. As the contents begin to move, the bulk or the majority of the contents are directed towards the filler 30 or the retention tank 320 and flow therein.

In the scrape step, the compressed air valve 160 is closed and the blower valve 190 is opened on the air line 130 to continue moving the contents. The blower 170 thus provides high velocity air to the air line 130 and the pipe 10. The pressure may be lowered to about 0.2 bar while the blower may provide air at up to about 45 meters per second or so. Other pressures and velocities may be used herein. The air flow now has a lower air pressure but higher velocity so as to discharge the bulk of the contents into the filler or the retention tank 320. Once the bulk of the contents have been evacuated, the collection valve 310 is opened such that substantially all residual contents are directed towards the retention tank 320. The contents may be separated from the airflow via the fluid-gas separator 330 in the retention tank 320 as described above. The collected contents then may be passed to the filler 30 via the filler line 370.

In the rinse step, the three way valve 120 opens to link the air line 130 and the pipe 10 towards the filler 30 while closing the line 130 to the escape valve 220. A small amount of water may be injected into the air line 130 via the water system 250 and the source of treated water 260. The volume may be about five (5) to about ten (10) meters per minute. Other volumes may be used herein. The combination of the blower 170 and the water system 250 provides a vortex-like airflow with the water so as to clean the air line 130 and the other elements.

In the dry step, the water system 250 is turned off via the water valve 280. The blower 170 continues to blow so as to remove any residual moisture remaining within the air line 130 from the rinse phase described above while the valve 220 is open.

In the chlorination and dry step, the chlorination system 290 of the water system 250 is used and an additional amount of water is injected into the air line 130 via the water system 250. This chlorination system 290 sanitizes the air line 130 so as to avoid any microbiological contamination of the liquid in the line 10 that could occur from the air line 130. The chlorination system 290 may be used on a regular schedule, for example every several weeks, or as desired. A chlorine tablet may be placed into chlorination system 290 and topped off with treated water so as to obtain a solution of about 150 parts per million of chlorine. Other types of solutions may be used herein. The valves 280, 120, 220 are opened such that the chlorine solution flows into the line 130. When the line 130 is full, the escape valve 220 is closed for a contact time of about five (5) minutes or so. Other lengths of time may be used herein. The valve escape 220 is then opened and the line 130 is rinsed with treated water until the chlorine is fully eliminated. The line 130 may then be dried using the blower 170. The pipe 10 also may be sanitized in a similar manner.

The higher pressure thus is used initially so as to place the contents of the pipe 10 into motion. While the contents are in motion but before the pipe 10 is emptied, the pressure is reduced and the velocity is increased. This lower pressure and higher velocity airflow is continued once the bulk of the contents are removed so as to remove also any residue left in the pipe 10. The air line 130 may then be cleaned and sanitized.

It should be apparent that the foregoing relates only to the preferred embodiments of the present application and that numerous changes and modification may be made by one of ordinary skill in the art without departing from the general spirit and scope of the invention as defined by the following claims and the equivalents thereof.

We claim:

1. A method of clearing a pipe in a beverage bottling system of contents with an air system and a water system, comprising:

providing air by the air system at a first pressure and a first velocity as a laminar air flow until the contents begin to move within the pipe;

providing air by the air system at a second pressure and a second velocity once the contents begin to move and continuously until a majority of the contents are removed from the pipe, wherein the first pressure is greater than the second pressure, and the second velocity is greater than the first velocity;

continuing to provide air at the second pressure and the second velocity until substantially all remaining contents are removed from the pipe;

directing substantially all of the contents from the pipe towards a retention tank;

operating the retention tank as a fluid-gas separator to separate the contents from the air;

passing the separated contents in the retention tank to a filler that is configured to dispense beverage into containers during operation of the beverage bottling system; and rinsing the air system with water from the water system and airflow from the blower.

2. The method of claim 1, wherein the first pressure comprises about 0.5 to about 2.0 bars.

3. The method of claim 1, wherein the second pressure comprises about 0.2 bars.

4. The method of claim 1, wherein the second velocity comprises up to about ten (10) meters per second.

5. The method of claim 1, wherein the step of continuing to provide air at the second pressure and the second velocity until substantially all remaining contents are removed from the pipe comprises flowing the remaining contents to a fluid-gas separator.

6. The method of claim 1, further comprising drying the air system.

7. The method of claim 6, further comprising chlorinating the air system.

8. The method of claim 1, further comprising the step of compressing air provided to the pipe.

9. The method of claim 1, further comprising the step of filtering air provided to the pipe.

10. The method of claim 1, further comprising the step of metering air provided to the pipe.

11. The method of claim 1, further comprising the step of regulating air provided to the pipe.

12. A method of clearing a pipe in a beverage bottling system of a liquid with an air system and a water system, comprising:

providing a laminar air flow by the air system at a first pressure and a first velocity until the liquid begins to move within the pipe;

providing a turbulent air flow by the air system air at a second pressure and a second velocity once the liquid begins to move and continuously until a majority of the liquid is removed from the pipe, wherein the first pressure is greater than the second pressure, and the second velocity is greater than the first velocity;

continuing to provide the turbulent air flow at the second pressure and second high velocity until substantially all the liquid is removed from the pipe;

directing substantially all of the liquid from the pipe towards a retention tank;

operating the retention tank as a fluid-gas separator to separate the liquid from the air;

passing the separated liquid in the retention tank to a filler that is configured to dispense beverage into containers during operation of the beverage bottling system;

rinsing the air system with water from the water system and airflow from the blower.

13. The method of claim 12, wherein the step of providing a laminar flow by the air system comprises providing a laminar flow by a compressed air source.

14. The method of claim 12, wherein the step of providing a turbulent flow by the air system comprises providing a turbulent flow by a blower.

15. A method of clearing a pipe in a beverage bottling system of contents with an air system and a water system, consisting of:

providing air by the air system at a first pressure and a first velocity as a laminar air flow until the contents begin to move within the pipe;

providing a turbulent air flow by the air system at a second pressure and a second velocity until a majority of the contents are removed from the pipe;

continuing to provide air at the second pressure and a second velocity until substantially all remaining contents are removed from the pipe;

directing substantially all of the contents from the pipe towards a retention tank;

operating the retention tank as a fluid-gas separator to separate the contents from the air;

passing the separated contents in the retention tank to a filler that is configured to dispense beverage into containers during operation of the beverage bottling system; and rinsing the air system with water from the water system and airflow from the blower.

* * * * *